US005172936A

United States Patent [19]

Sullivan et al.

[11] Patent Number: 5,172,936

[45] Date of Patent: Dec. 22, 1992

[54] IN-MOLD LABEL HAVING REMOVABLE COUPON PORTION

[75] Inventors: Brian P. Sullivan; Robert J. Wojewoda, both of Cincinnati; Theodore R. Zeiter, Amelia, all of Ohio

[73] Assignee: Multi-Color Corporation, Cincinnati, Ohio

[21] Appl. No.: 682,421

[22] Filed: Apr. 8, 1991

[51] Int. Cl.[5] ..... B42D 15/00

[52] U.S. Cl. ..... 283/81; 40/306; 40/310; 428/42; 428/43

[58] Field of Search ..... 283/81, 105, 74; 40/306, 310, 312, 299, 630; 428/41, 42, 43, 44, 211

[56] References Cited

U.S. PATENT DOCUMENTS 4,318,235 3/1982 Augeri ..... 283/105 X
4,621,837 11/1986 Mack ..... 283/105
5,021,274 6/1991 Beck et al. ..... 283/105 X
5,056,827 10/1991 Sasso ..... 283/105

*Primary Examiner*—Timothy V. Eley
*Assistant Examiner*—Willmon Fridie, Jr.
*Attorney, Agent, or Firm*—Frost & Jacobs

[57] ABSTRACT

The present invention relates to a label, particularly for in-mold application, and containers and articles having such a label.

The label of the present invention is one designed for attaching to a surface and is adapted to allow removal of at least one portion of the label from the surface. The label has at least one permanent portion and at least one removable portion, with the permanent portion(s) having a sufficient amount of adhesive to provide permanent adhesion to the surface while the removable portion(s) is provided with an amount of adhesive to provide relatively less adhesion so as to allow the removable portion to be removed from the surface. Preferably, such lesser amount of adhesive provides a degree of adhesion less than both the tear modulus and the proportional limit of the removable portion(s).

49 Claims, 3 Drawing Sheets

IN-MOLD LABEL HAVING REMOVABLE COUPON PORTION

BACKGROUND

The present invention relates to a label, particularly for use in in-mold applications, having one or more removable portions. The removable portion(s) may be used to carry indicia such as coupons, proofs-of-purchase or contest pieces, whose use has become popular in labeling a wide variety of items and containers.

One of the problems faced in designing labels with removable portions is to provide for the removable portion to be attractive and legible as well as easily and neatly removable. In most labeling environments, it is desirable to have both the removable portion and the balance of the label remain flat against the labelled surface to maximize legibility and make the labelled surface or container more attractive. Also, it is preferred to allow a portion of the removable portion to be easily grasped by the person desiring to remove the removable portion. Accordingly, it is desirable to provide an unadhered tab portion on the removable portion which can be easily grasped and pulled to effect removal.

In removing the label's removable portion, it is most advantageous to provide a means to allow the removable portion to be easily and cleanly taken from the labelled surface. This is important so that one removing such portion can do so with little effort and without mutilating the removable portion or disturbing the indicia either on the removable portion or the remaining balance of the label. More specifically this involves providing a removable portion whose adhesion to the underlying surface and attachment to the balance of the label will not exceed the tear modulus or the elastic limit of the label material upon removal.

Another problem associated particularly with in-mold labels is to provide all of the above advantages in a label amenable to in-mold application. Some of the particular obstacles include maintaining the appropriate characteristics in such a label to allow it to comport to the various physical and thermal requirements of adhesion to a given molded container or product. These characteristics include the proper degree of adhesion for the removable portion, its tab and the balance of the label, and the appropriate coshrinkage between the entire label and the molded surface to which it is applied. Also, the control of adhesion and coshrinkage prevents blistering and puckering which results in a label that may be insecurely attached and/or illegible.

An example of an in-mold label of the prior art is disclosed in U.S. Pat. No. 4,587,158 issued to Ewing on May 6, 1986 and reissued as U.S. Reissue Pat. No. Re. 32,929 issued May 23, 1989, and Japanese Patent Application No. 56-169117 by Yasuda filed Oct. 22, 1981 and published Apr. 25, 1983, which are hereby incorporated herein by reference.

In accordance with the above characteristics and desired advantages, the present invention provides a label having at least one removable portion which can be easily and cleanly removed, and which provides for clear display of indicia on both the permanent and removable portion both before and after removal of the removable portion. The present invention also makes these advantages available to a label applied in an in-mold setting.

SUMMARY OF THE INVENTION

In accordance with the foregoing objective and desired advantages, the invention in its most general form comprises a label for attaching to a surface and adapted to allow removal of at least one portion of the label from the surface. The label comprises at least one permanent portion and at least one removable portion. Each portion of the label has an adhering side and a display side, the adhering side being the reversed side which adheres to the surface of the article or container and the display side being the facing side on which the label indicia is placed.

The adhering side of the permanent portion(s) is/are provided with a sufficient amount of adhesive to adhere such portion(s) to the surface. The adhering side of the removable portion(s) is/are provided with an amount of adhesive less than the amount of adhesive on the adhering side(s) of the permanent portion(s) so as to allow the removable portion(s) to be adhered to the surface of the article or container while being capable of being removed from the surface by persons such as the consumer of the article or container.

In a preferred embodiment, the removable portion(s) is/are disposed along an edge of the label with a region of the adhering side of the removable portion(s) nearest the edge maintained free of adhesion onto the surface so as to form a pull tab which may be easily grasped to effect removal of the removable portion(s). Also, it is preferred that the removable portion(s) have borders which are perforated, and most preferably scored, to ease removal and prevent distortion or destruction of the permanent and removable portions of the label.

The invention also comprises a container or article of manufacture having a label produced in accordance with the present invention.

More particularly, the present invention also relates to an in-mold label designed to be attached to a molded surface and adapted to allow removal of at least one portion of the label from the surface. This label comprises at least one permanent portion and at least one removable portion with each of these portions having adhering and display sides. The display sides are designed to have indicia printed thereupon.

The adhering side of the permanent portion(s) is provided with a sufficient degree of adhesion to adhere the permanent portion(s) to the molded surface so as to maintain its substantially completely adhered to the molded surface.

The adhering side of the removable portion(s) is provided with a lesser degree of adhesion than that provided to the permanent portion(s) (in proportion to the respective areas to which each of the amounts are applied) so as to maintain the removable portion(s) substantially completely adhered to the molded surface while maintaining the adhesion between the molded surface and the removable portion(s) less than the tear modulus of the removable portion(s).

One way of providing differential degrees of adhesion is to provide varying amounts of adhesive. An alternative is to use an adhesive contaminent such as BASF VEXP 567 with 0–10% wax to lessen the degree of adhesion.

As in the case of the more general label, the present invention described above, the label of the present invention for in-mold use may also have its removable portion(s) disposed on an edge of the label with a region of the adhering side of the such removable portion(s)

nearest the label's edge maintained free of adhesion onto the surface so as to form a pull tab on the removable portion(s) along the edge of the label. In this way, a portion of the removable portion(s) can be easily grasped and removal of the removable portion(s) more easily initiated. In the case of in-mold labels, such pull tabs being free of adhesion to the molded surface, will in many instances, naturally distort or pucker so as to come away from the molded surface rendering them more easily handled to initiate the removal process.

As is the case with the more general label described above, the removable portion(s) used in the in-mold application are preferably perforated and/or scored along the borders to further facilitate removal without destruction or distortion of the removable portion(s) or the remaining permanent portion(s).

The material(s) used to produce the label of the present invention may be any material(s) known in the labelling art. Such materials generally include polymeric and paper-based materials. An example of such material is the high density polyethylene materials, such as P-247 commercially available from Clopay Corporation of Cincinnati, Ohio. Such materials are generally available in sheet form from which the labels are printed and cut according to methods known in the art.

The adhesives which may be used to affix the labels of the present invention may be selected from any appropriate heat sensitive and pressure sensitive adhesives. Such adhesives for in-mold applications may include, thermoplastic adhesives. As used herein the term "thermoplastic adhesive" shall include any material combining a thermoplastic material and a tackifer, including sealants which may be used in so-called "adhesiveless" applications. Generally such adhesives are materials which will bond to the surface to be labelled when they are heated above their respective melting points. Dissimilar materials require the use of tackifiers to produce sufficient adhesive bonding.

The adhesive(s) may be applied by any means commonly used in the art such as those using screens and gravure cylinders, including slot coating and extrusion coating.

A preferred method of allowing the formation of a non-adhered tab portion to each removable portion involves either to keep the adhering side of such tab free from adhesive or to use a release coating on that part of the surface below the tab portion.

DETAILED DESCRIPTION OF THE PREFERRED EMBODIMENTS

The following is a description of the preferred embodiments of the invention and, as such, constitute the best modes of the invention, for their respective purposes.

Figure 1:
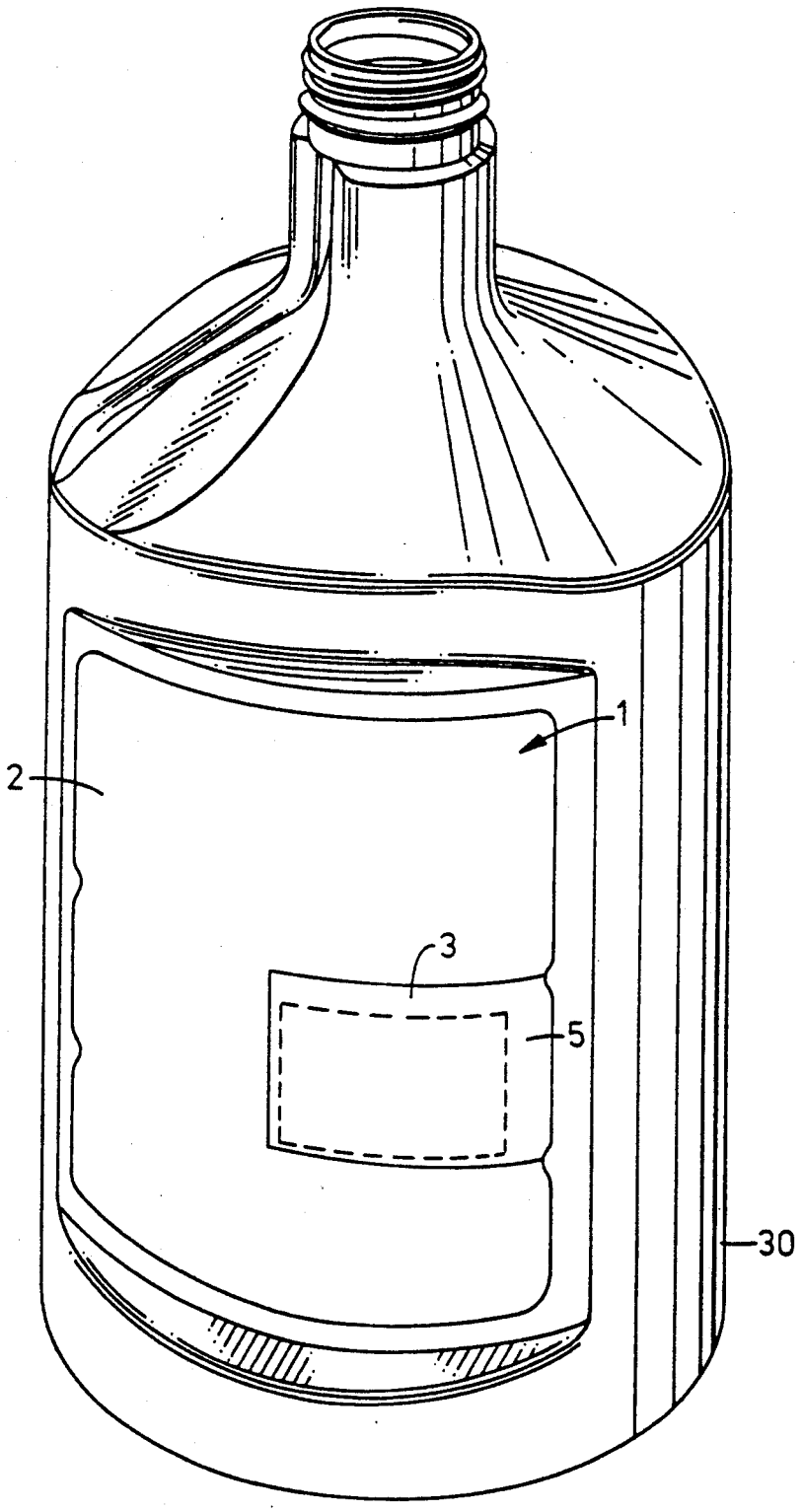
FIG. 1 is an environmental view of a label attached to a molded article in accordance with one embodiment of the invention.

FIG. 1 shows label 1 attached to an article's surface, the article in this case being a blow-molded motor oil container 30.

Figure 2:
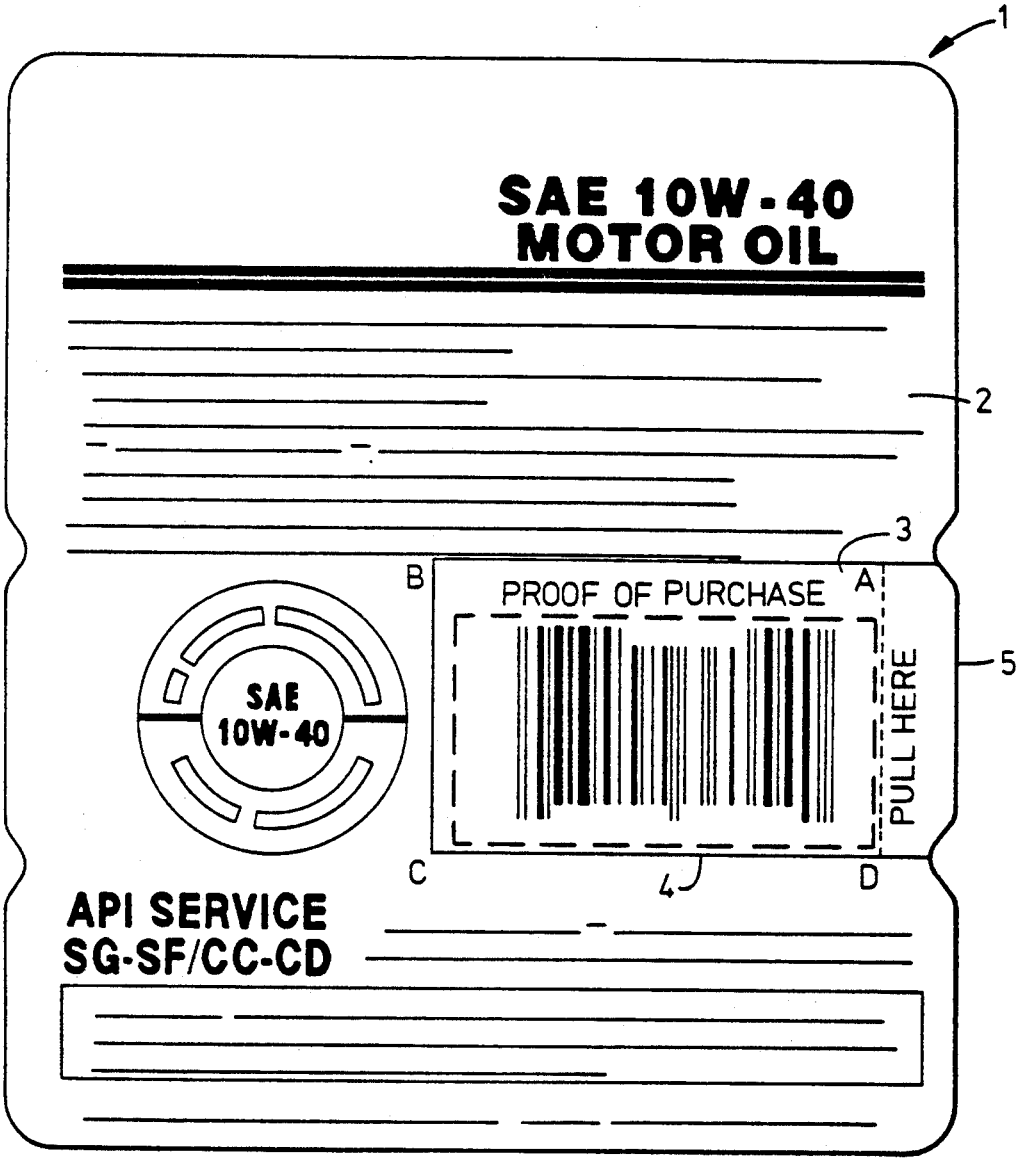
FIG. 2 is a plan view of the display side of a label in accordance with one embodiment of the present invention.

FIG. 2 shows the display side of a label 1 made in accordance with the present invention and used in an in-mold application. Label 1 comprises a permanent portion 2 and a removable portion 3. the removable portion 3 includes a main portion 4 defined by quadrangle ABCD and a tab portion 5 comprising the balance of the removable portion and defined in part by line AD and a portion of the edge of the label 1.

Both the permanent portion 2 and the removable portion 3 have indicia on their display sides. For instance, as seen in FIG. 2, the label 1 contains the indicia for a motor oil container with the permanent portion bearing company name and oil specification information while the removable portion bears a proof-of-purchase bar code for redemption.

Figure 3:
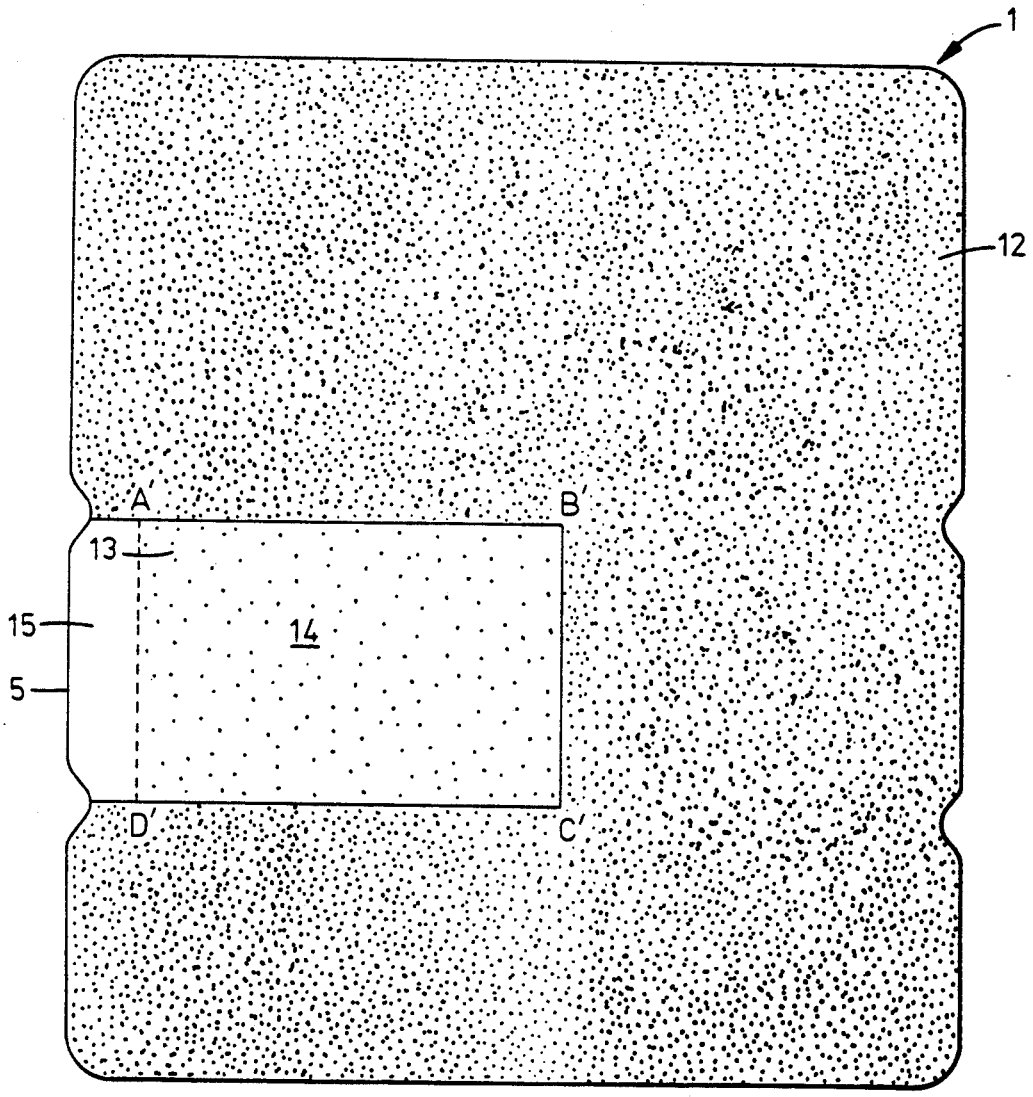
FIG. 3 is a plan view of the adhering side of a label in accordance with one embodiment of the present invention.

FIG. 3 shows the corresponding reverse side—the adhering side—of the label 1. The adhering side comprises regions 12 and 13 corresponding respectively to the regions of the adhering side underlying the permanent portion 2, the main portion 4 of the removable portion 3 and the tab portion 5 of the removable portion 3. This arrangement is further indicated by the designation of quadrangle A'B'C'D' which defines region 14 and corresponds to quadrangle ABCD on the display side.

Region 12 is provided with an amount of adhesive sufficient to maintain the permanent portion 2 flat against the surface of the labeled article. Region 13 is provided with a relatively lesser amount of adhesive which holds it flat against the surface of the labeled article while allowing it to be peeled off without destroying or distorting either portion of the label or the indicia thereupon.

In order to ease removal, the borders of the removable portion (i.e. lines AB, BC and CD) are preferably scored and perforated. A preferred length of the tab portion is between about $\frac{3}{8}''$ and about $\frac{1}{2}''$.

The tab portion 15 is preferably made of sufficient size to be easily grasped and, by being made of a label material that will deform unless adhered to the surface, the natural puckering or blistering will cause the tab portion 15 to be raised slightly from the article surface. This makes the tab portion more easily graspable.

The amount and application of adhesive to the label may be controlled for instance by application parameters.

The borders of the removable portion 3 preferably may be weakened to allow easier separation and removal. This may be done by perforation and/or by scoring, particularly "slit scoring". Slit scoring is a method of scoring which does not completely penetrate the label material. Rather, the label material is slit on its upper surface, usually by a sharp knife, blade or wheel, to weaken the region making tearing easier. By slit scoring, the direction of tear, especially in polymeric labels, is controlled by lessening the amount of inelastic deformation which can cause the tear to depart from the intended line and distort or destroy the label and/or the removable portion.

The following working examples represent the best mode of the invention and adhesive application and distribution.

EXAMPLES

The materials used in the following examples are as follows:

1. Label Material ("Film") - P-247 HDPE available from Clopay Corp.

2. Adhesive: Morton 31DW2062 (an EVA-based gel lacquer)
3. Bottle: HDPE blow-molded bottle

EXAMPLE 1

In this embodiment of the invention, a label of HDPE is provided with Morton International 31DW2062 adhesive using a gravure printing process. The gravure cylinder used for the permanent or non-coupon portion uses a 60-line screen with a depth of 80 microns and a 50 micron wall. For application to the coupon area of the label, a 200 line screen with a 20 micron depth and 27 micron wall is used. The amount of adhesive in terms of coating weight per unit area is 3.2 to 4.0 gr/m$^2$ for the non-coupon area while the coupon area is provided with ½ to 1½ gr/m$^2$ adhesive In this label, the coupon borders are slit scored without perforation. A tab portion of the coupon portion is located alonge one edge of the non-coupon portion and notches are made in the label where the slit scored borders intersect the label edge.

EXAMPLE 2

This embodiment is the same as that described in Example 1 with the exception that two different adhesives are used on the non-coupon areas. In this embodiment, Morton International 31DW2062, an aggressive adhesive, is used on the non-coupon portion while Morton International 33DW2086 adhesive, a less aggressive adhesive, is used for the coupon portion.

EXAMPLE 3

This embodiment is the same as that in Example 1 with the exception that all of the coupon portion is supplied with the same amount of adhesive as the non-coupon portions, (i.e. using the same gravure type) and the adhesive applied to the adhering side of the removable portion contains a contaminant, in this case BASF VEXP 567 with 8–10% wax content.

In accordance with the foregoing disclosure, its variations and modifications, and the use of equivalents may be made without departing from the invention's spirit.

What is claimed is:

1. A label for attaching to a surface and adapted to allow removal of at least one portion of said label from said surface, said label comprising:

(1) at least one permanent portion and (2) at least one removable portion, each of said portions having adhering and display sides; said display sides having indicia thereupon;

and wherein said adhering side of said at least one permanent portion is provided with an adhesive coating providing sufficient adhesion to adhere said at least one permanent portion to said surface and wherein said adhering side of said at least one removable portion is provided with an adhesive coating providing less adhesion than said adhesion provided by said adhesive coating on said adhering side of said at least one permanent portion so as to allow said at least one removable portion to be adhered to said surface while being capable of being removed from said surface.

2. A label according to claim 1 wherein the same adhesive is used on the adhering side of said at least one permanent label portion and on the adhering side of said at least one removable portion, said less adhesion of said at least one removable portion is obtained by providing an amount of adhesive per area to said adhering side of said at least one removable portion less than said amount of adhesive per area of said adhering side of said at least one permanent portion.

3. A label according to claim 1 wherein the same adhesive is used on the adhering side of said at least one permanent label portion and on the adhering side of said at least one removable portion, said less adhesion of said at least one removable portion is obtained by including with said adhesive on said adhering side of said at least one removable portion, an effective amount of at least one adhesive contaminant.

4. A label according to claim 1 wherein said at least one removable portion is disposed on an edge of said label and wherein a region of said adhering side of said at least one removable portion nearest said edge is maintained free of adhesion onto said surface so as to form a pull tab on said at least one removable portion along said edge of said label.

5. A label according to claim 4 wherein said removable portion has borders intersecting said edge, and notches formed in said label where said borders intersect said edge.

6. A label according to claim 1 wherein said at least one removable portion is disposed on an edge of said label, and wherein a region of said adhering side of said at least one removable portion nearest said label edge is provided with a release coating so as to form a pull tab on said at least one removable portion along said label edge.

7. A label according to claim 6 wherein said removable portion has borders intersecting said edge, and notches formed in said label where said borders intersect said edge.

8. A label according to claim 1 wherein said at least one removable portion has borders and wherein the portions of said label corresponding to at least one of said borders is weakened by at least one process selected from the group consisting of perforating, scoring and slit scoring.

9. A label according to claim 4 wherein said at least one removable portion has borders and wherein the portions of said label corresponding to at least one of said borders is weakened by at least one process selected from the group consisting of perforating, scoring and slit scoring.

10. A label according to claim 1 wherein said at least one removable portion has borders and wherein said borders are slit scored.

11. A label according to claim 1 wherein said at least one removable portion has borders and wherein said borders are both perforated and slit scored.

12. A container having a label according to claim 1.

13. A container having a label according to claim 2.

14. A container having a label according to claim 3.

15. A container having a label according to claim 4.

16. A container having a label according to claim 6.

17. A container having a label according to claim 7.

18. A container having a label according to claim 9.

19. An article of manufacture having a label according to claim 1.

20. An article of manufacture having a label according to claim 2.

21. An article of manufacture having a label according to claim 3.

22. An article of manufacture having a label according to claim 4.

23. An article of manufacture having a label according to claim 6.

24. An article of manufacture having a label according to claim 7.

25. An article of manufacture having a label according to claim 9.

26. A label according to claim 1 wherein said less adhesion of said at least one removable portion is obtained by said adhesive applied thereto being less aggressive than said adhesive applied to said at least one permanent portion.

27. An in-mold label for attaching to a molded surface and adapted to allow removal of at least one portion of said label from said surface, said label comprising;

(a) at least one permanent portion and (b) at least one removable portion each of said portions having adhering and display sides; and display sides having indicia thereupon;

and wherein said adhering side of said at least one permanent portion is provided with a first amount of adhesive to provide sufficient adhesion to adhere said at least one permanent portion to said molded surface so as to maintain said at least one permanent portion substantially completely adhered to said molded surface;

and wherein said adhering side of said at least one removable portion is provided with a second lesser amount of said adhesive to provide less adhesion than said adhesion provided by said first amount in proportion to the respective areas to which each said amounts are applied, so as to maintain said at least one removable portion substantially completely adhered to said molded surface and whereby the adhesion between said molded surface and each said at least one removable portion is less than the tear modulus of each said at least one removable portion respectively.

28. A label according to claim 27 wherein said at least one removable portion is disposed on an edge of said label and wherein a region of said adhering side of aid at least one removable portion nearest said edge is maintained free of adhesion onto said molded surface so as to form a pull tab on said at least one removable portion along said edge of said label.

29. A label according to claim 26 wherein said region of said adhering side of said at least one removable portion is provided with a release coating.

30. A label according to claim 27 wherein said at least one removable portion has borders and wherein the portions of said label corresponding to at least one of said borders is weakened by at least one process selected from the group consisting of perforating, scoring and slit scoring.

31. A label according to claim 28 wherein said at least one removable portion has borders and wherein the portions of said label corresponding to at least one of said borders is weakened by at least one process selected from the group consisting of perforating, scoring and slit scoring.

32. A label according to claim 27 wherein said at least one removable portion has borders and wherein said borders are slit scored.

33. A label according to claim 27 wherein said at least one removable portion has borders and wherein said borders are both perforated and slit scored.

34. A label according to claim 27 wherein said adhesive is selected from the group consisting of heat sensitive and pressure sensitive adhesives.

35. A label according to claim 27 wherein said adhesive is selected from the group consisting of thermoplastic adhesives.

36. A container having a label according to claim 27.

37. A container having a label according to claim 29.

38. A container having a label according to claim 29.

39. A container having a label according to claim 30.

40. A container having a label according to claim 31.

41. A container having a label according to claim 32.

42. A container having a label according to claim 33.

43. An article of manufacture having a label according to claim 26.

44. An article of manufacture having a label according to claim 29.

45. An article of manufacture having a label according to claim 29.

46. An article of manufacture having a label according to claim 30.

47. An article of manufacture having a label according to claim 31.

48. An article of manufacture having a label according to claim 32.

49. An article of manufacture having a label according to claim 33.

* * * * *

UNITED STATES PATENT AND TRADEMARK OFFICE

CERTIFICATE OF CORRECTION

PATENT NO. : 5,172,936

DATED : December 22, 1992

INVENTOR(S) : Brian P. Sullivan, Robert J. Wojewoda, Theodore R. Zeiter

It is certified that error appears in the above—identified patent and that said Letters Patent is hereby corrected as shown below:

Column 7, claim 26 - claim 26 should be deleted in its entirety.
Column 7, claim 27, line 10, "27" should be deleted and replaced with --26--.
Column 7, claim 27, line 15, "display sides; and" should be deleted and replaced with --display sides; said--.
Column 7, claim 28, line 37, "28" should be deleted and replaced with --27--.
Column 7, claim 29, line 44, "29" should be deleted and replaced with --28--.
Column 8, claim 30, line 1, "30" should be deleted and replaced with --29-- and "27" should be deleted and replaced with --26--.
Column 8, claim 31, line 7, "31" should be deleted and replaced with --30-- and "28" should be deleted and replaced with --27--.
Column 8, claim 32, line 13, "32" should be deleted and replaced with --31-- and "27" should be deleted and replaced with --26--.
Column 8, claim 33, line 16, "33" should be deleted and replaced with --32-- and "27" should be deleted and replaced with --26--.
Column 8, claim 34, line 19, "34" should be deleted and replaced with --33-- and "27" should be deleted and replaced with --26--.
Column 8, claim 35, line 22, "35" should be deleted and replaced with --34-- and "27" should be deleted and replaced with --26--.
Column 8, claim 36, line 25, "36" should be deleted and replaced with --35-- and "27" should be deleted and replaced with --26--.
Column 8, claim 37, line 26, "37" should be deleted and replaced with --36-- and "29" should be deleted and replaced with --27--.
Column 8, claim 38, line 27, "38" should be deleted and replaced with --37-- and "29" should be deleted and replaced with --28--.
Column 8, claim 39, line 28, "39" should be deleted and replaced with --38-- and "30" should be deleted and replaced with --29--.
Column 8, claim 40, line 29, "40" should be deleted and replaced with --39-- and "31" should be deleted and replaced with --30--.
Column 8, claim 41, line 30, "41" should be deleted and replaced with --40-- and "32" should be deleted and replaced with --31--.
Column 8, claim 42, line 31, "42" should be deleted and replaced with --41-- and "33" should be deleted and replaced with --32--.

UNITED STATES PATENT AND TRADEMARK OFFICE

CERTIFICATE OF CORRECTION

PATENT NO. : 5,172,936 Page 2 of 2

DATED : December 22, 1992

INVENTOR(S) : Brian P. Sullivan, Robert J. Wojewoda, Theodore R. Zeiter

It is certified that error appears in the above—identified patent and that said Letters Patent is hereby corrected as shown below:

Column 8, claim 43, line 32 "43" should be deleted and replaced with --42--.
Column 8, claim 44, line 34, "44" should be deleted and replaced with --43--.
Column 8, claim 44, line 35, "29" should be deleted and replaced with --27--.
Column 8, claim 45, line 36, "45" should be deleted and replaced with --44-.
Column 8, claim 45, line 37, "29" should be deleted and replaced with --28--.
Column 8, claim 46, line 38, "46" should be deleted and replaced with --45--
Column 8, claim 46, line 39, "30" should be deleted and replaced with --29--.
Column 8, claim 47, line 40, "47" should be deleted and replaced with --46--.
Column 8, claim 47, line 41, "31" should be deleted and replaced with --30--.
Column 8, claim 48, line 42, "48" should be deleted and replaced with --47--.
Column 8, claim 48, line 43, "32" should be deleted and replaced with --31--.
Column 8, claim 49, line 44, "49" should be deleted and replaced with --48--.
Column 8, claim 49, line 45, "33" should be deleted and replaced with --32--.

Signed and Sealed this

Sixteenth Day of November, 1993

*Attest:*

Bruce Lehman

BRUCE LEHMAN

*Attesting Officer*

*Commissioner of Patents and Trademarks*